United States Patent [19]

Conti

[11] Patent Number: 4,502,713

[45] Date of Patent: Mar. 5, 1985

[54] POSTAL FORMS

[76] Inventor: Romano Conti, Via P. della Francesca, 37-Prato(Firenze), Italy

[21] Appl. No.: 470,324

[22] Filed: Feb. 28, 1983

[30] Foreign Application Priority Data

Mar. 9, 1982 [IT] Italy ..... 11575/82[U]

[51] Int. Cl.[3] ..... B42D 15/00; B41L 1/20; B41L 1/22

[52] U.S. Cl. ..... 283/1 B; 282/25; 282/11.5 R

[58] Field of Search ..... 282/11.5, 25; 283/1 A, 283/1 B

[56] References Cited

U.S. PATENT DOCUMENTS

| | | | |
|---|---|---|---|
| 2,129,581 | 9/1938 | Holden | 283/1 B |
| 3,261,623 | 7/1966 | Kiedrowski | 282/25 |
| 3,666,926 | 5/1972 | Conte, Jr. et al. | 283/1 B X |
| 4,320,868 | 3/1982 | Petersson | 282/25 |

FOREIGN PATENT DOCUMENTS

| | | | |
|---|---|---|---|
| 7903080 | 2/1979 | France | 283/1 B |
| 566647 | 1/1945 | United Kingdom | 283/1 B |
| 2029371 | 3/1980 | United Kingdom | 283/1 B |

*Primary Examiner*—Paul A. Bell
*Assistant Examiner*—Paul M. Heyrana, Sr.
*Attorney, Agent, or Firm*—McGlew and Tuttle

[57] ABSTRACT

A form suitable for electricity, gas, water or telephone bills, bank statements etc., which can be folded and stuck down for postal dispatch, comprises at least two rectangular elongate regions which can be folded one on to the other, and sticking strips for stabilizing the folded state. The rear face of the form, i.e. that opposite the compiled or printed face, is free from partially pre-glued regions in that part of the form on which its front face is to be printed, and which can thus slide on a backing plate. In these regions sticking is carried out by distributing liquid glue when required, or by previously applying a dry thermosetting glue, and then distributing a moistening agent when these regions are to be stuck.

8 Claims, 8 Drawing Figures

POSTAL FORMS

BACKGROUND OF THE INVENTION

Technical Field

The invention relates to a form suitable for messages printed in large quantities, such as electricity, gas, water or telephone bills, bank statements etc. The invention particularly relates to forms which are provided as a continuous web. Each form can, after printing, be separated, folded and stuck down for postal despatch. Such forms each typically include two rectangular elongate regions which can be folded one on to the other, and sticking strips for stabilising the folded state which have been partially pre-glued so that they adhere together by pressure.

Difficulties with such forms may arise with the printing equipment, especially where this is of the laser type, which are caused by the pre-gluing on the rear face of the form, i.e. that opposite the printed face.

SUMMARY OF THE INVENTION

The present invention provides a form having flat and folded states, having front and rear surfaces in said flat state, a portion of the rear surface of said form being adapted to slide on a backing plate during an operation to compile said front surface of said form in said flat state, said form including two adjacent rectangular regions which are adapted to be folded one on to the other in said folded state of said form, and a plurality of sticking strips adapted to maintain said form in said folded state, at least some of said sticking strips being partially pre-glued such that they adhere together under pressure, said pre-glued sticking strips being disposed such that said rear surface portion is free thereof.

The invention also provides a form having a front surface adapted to be printed on and a rear surface; said form being defined by a first rectangular region having two parallel longitudinal edges and two transverse short edges joining the ends of said longitudinal edges, a second rectangular region having parallel longitudinal edges and short transverse edges joining the ends of said longitudinal edges, and an intermediate region joining adjacent longitudinal edges of said first and second regions, the transverse and longitudinal dimensions of said second region being smaller than those of said first region; a first creasing line defined along the longitudinal edge of said first region adjacent the intermediate region; a second creasing line extending across said first and second regions intermediate and parallel to said short transverse edges thereof; first and second pre-glued sticking strips adapted to adhere together under pressure on the rear surface of the form adjacent said short transverse edges of said first region, said first and second sticking strips leaving an area of the rear surface of said first region having a longitudinal dimension equal to or greater than the longitudinal dimension of said second region free of pre-gluing; said form being placed in a folded state by first folding said form along said first creasing line to bring the rear surfaces of said first and second regions face to face, and then folding the form along said second creasing line so as to bring said pre-glued sticking strips into contact with one another to hold said form in said folded state.

DESCRIPTION OF PREFERRED EMBODIMENTS

Figure 1:
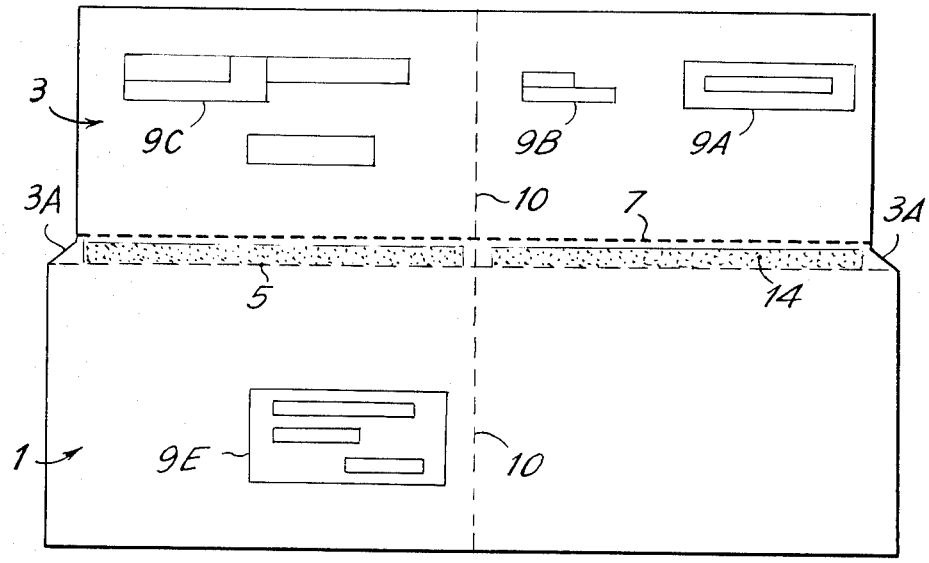
FIG. 1 is a view of an unfolded form with the surface which is to be compiled or printed uppermost.

As shown in FIGS. 1 to 4 of the accompanying drawing, the form comprises two elongate rectangular regions 1,3 which are separated from each other by a creasing line 5. The form region 3 is slightly smaller than the region 1, and a connecting edge region 3A is provided to join the two edges perpendicular to the creasing line 5 on each side of the form. Either adjacent to or coinciding with the creasing line 5, the rectangular region 3 comprises a scored or perforated separation line 7. When the form is folded for despatch, the region 1 must be external and the region 3 internal.

Figure 2:
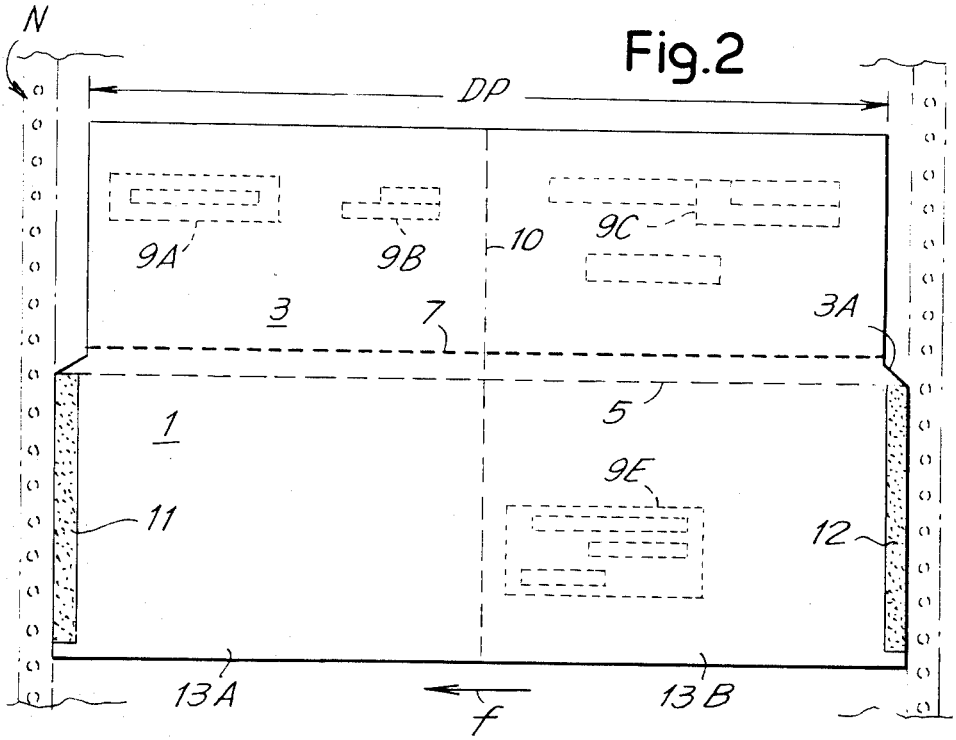
FIG. 2 shows the rear face of the unfolded form.

The surface shown in FIG. 1 is that which is to be compiled or printed on. The reference numerals 9A,9B,9C indicate, by way of example, some parts of the compilation included in the region 3. A further compilation part 9E is located in the region 1 and represents the postal address of the receiver. FIG. 2 shows the rear surface of the form, in which the parts 9A,9B,9C,9E of the compilation have been shown by dashed lines, being visible only "by transparency". The rear surface of the form rests on a backing plate while the printing or compilation is taking place on the front surface by a suitable system such as a laser printer. In compilation machines, the continuous web N of forms (FIG. 2) passes by sliding with intermittent movement on the backing plate, the dimension of which is indicated in FIG. 2 by DP. This dimension is limited and does not substantially exceed the longitudinal dimension of region 3 of the form.

The region 3 can be reduced in length (and possibly also in width) not only by the absence of paper material, but also possibly by window apertures, in order to remain functionally equivalent.

Figure 3:
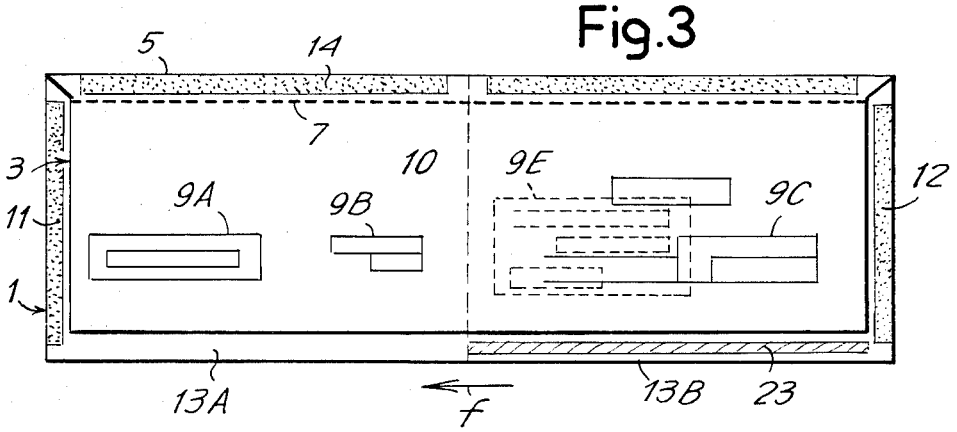
FIG. 3 shows the form of FIG. 1 folded longitudinally during a first folding stage.

After compiling the form and separating it from the continuous web N, the form is folded firstly along the line 5, so that the form assumes the state shown in FIG. 3. In a second stage, the form must be folded along a transverse central line 10 to pass from the state shown in FIG. 3 to the state shown in FIG. 4.

Figure 4:
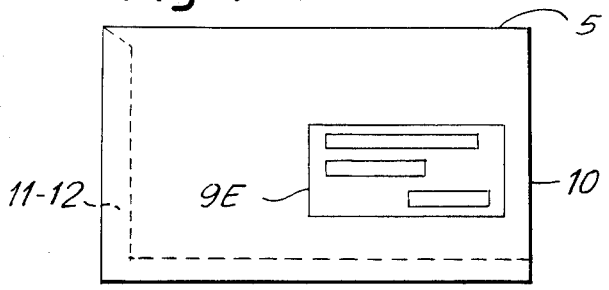
FIG. 4 shows a second and final folding stage of the form of FIG. 1.
Figure 5:
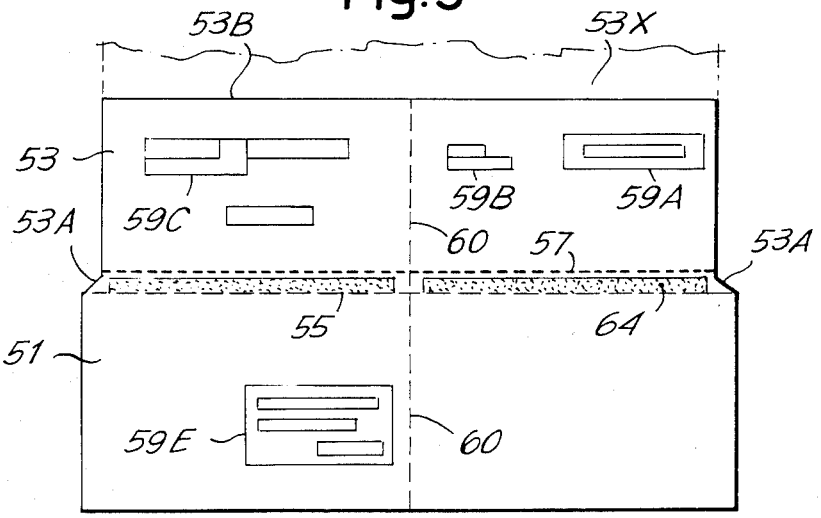
FIG. 5 shows a further embodiment of an unfolded form with the surface which is to be compiled or printed uppermost.
Figure 6:
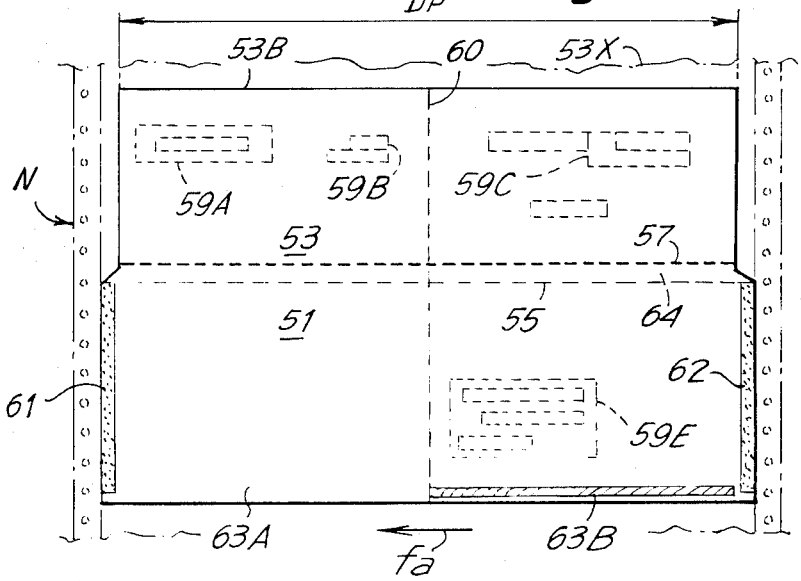
FIG. 6 shows the rear face of the form of FIG. 5.

Normally, the doubly folded state shown in FIG. 4 is stabilised by sticking regions, using partial pre-gluing, i.e. semi-gluing, of those surfaces to be stuck together, and which adhere together only when positioned opposite each other and pressed together. It is to be noted that a single pre-glued surface is not able to stick to a surface which has not bee prepared in a like manner. These pre-glued regions can be of the reversible type, i.e. they can be separated from each other and stuck together again several times.

In FIGS. 1 to 4, first and second pre-glued regions, indicated by 11 and 12, are provided on the rear surface transversely of the region 1 along the short sides thereof. These pre-glued regions 11 and 12 lie external to the plate of width DP when the continuous form N is inserted in the printing machine for its compilation. A third sticking region is necessary along the longitudinal edge of the region 1 opposite the edge defined by the creasing line 5. This third region indicated by the two sections 13A and 13B is not pre-glued. Consequently, there is no pre-glued surface sliding along the backing plate of width DP. A fourth strip 14 can be either a pre-glued or non-preglued sticking strip. The strip 14 extends along the front face between the creasing line 5 and the perforated line 7.

In order to seal the form when folded into the state shown in FIG. 4, the surfaces of the pre-glued strips 11 and 12 along the transverse edges are made to adhere together by suitable pressure, and the two opposing portions of the strip 14 are made to adhere together in the same manner. Whereas, in order to stick together the two parts 13A and 13B of the third strip, flue is distributed along at least one of the two parts 13A and 13B, preferably the part 13B (f being the direction of movement). This distribution is carried out usually by normal equipment, so as to deposit the glue in a thread-like arrangement as indicated by 23 (FIG. 3). The distribution can also be carried out on both the parts 13A and 13B. The distribution can be effected as the form is moving in the direction indicated by the arrow f, after the form has been folded longitudinally as shown in FIG. 3.

Consequently, the forms, which move as a continuous web N through the compilation apparatus, have no pre-glued surfaces on their rear surfaces in any position corresponding region which crosses and slides on the backing plate of dimension DP. This type of form thus obviates the drawbacks, complained of at the present time, of having to interrupt operation of the compilation apparatus because of the presence of pre-glued surfaces which tend to foul the said plate.

The glue 23 distributed in the region 13B can provide a fixing which is stable and thus more secure than that obtained by pre-glued regions. Even so, the closed form can be read by detaching along the lines 11,12 and along the region 14.

Besides the two regions 1 and 3, at least one or even more regions adjacent to the region 3 can be provided, in order to extend the useful surface for compilation. These regions are bounded by creasing lines.

The strip 14 need not be pre-glued, but instead can be glued by distribution of glue on folding, or alternatively can remain unglued.

The distribution of glue along the strip 13 (and possibly along the strip 14) can either by limited to only one half its length—and in particular the second half with respect to the direction of movement—or can comprise its whole length. The application of this glue may be carried out by using suitable arrangements, such as annular channels on the folding rollers, in order to prevent the folding machine becoming loaded with adhesive.

FIGS. 5 to 8 show a further embodiment in which the corresponding reference numerals have been increased by "50".

In FIGS. 5 to 8, first and second pre-glued regions indicated by 61 and 62 are provided on the rear surface of the form transversely of the region 51 along the short sides thereof. These pre-glued regions 61 and 62 lie external to the plate of width DP when the continuous web N of forms is inserted into the machine for its compilation. A third sticking region is necessary on the rear face along the longitudinal edge of the region 51 opposite the edge bounded by the creasing line 55. This third region, indicated by the two sections 63A and 63B, is not pre-glued, and instead at least one of them, for example the section 63B, is provided with dry/or thermosetting glue which can be activated by moistening with water etc. Consequently, there is no pre-glued surface to slide on the backing plate of dimension DP, but only a surface with dry glue which does not foul the plate. A fourth strip 64 is a sticking strip which can either be or not be treated by pre-gluing. The strip 64 extends along the front face between the creasing line 55 and the perforated line 57.

Figure 7:
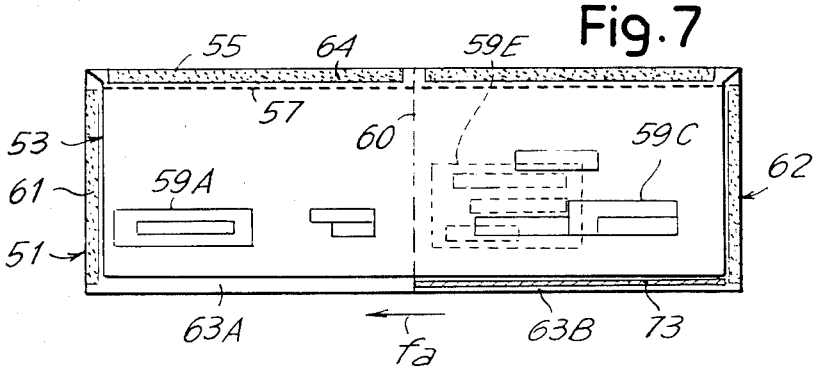
FIG. 7 shows the form of FIG. 5 folded longitudinally during a first folding stage.
Figure 8:
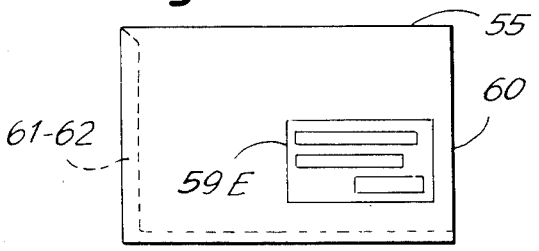
FIG. 8 shows the second and final folding stage of the form of FIG. 5.

In order to seal the form when folded into the state shown in FIG. 8, the surfaces of the pre-glued strips 61 and 62 along the transverse edges are made to adhere together by suitable pressure, and the two opposing portions of the strip 64 are made to adhere together in the same manner if pre-glued. In order to stick together the two parts 63A and 63B of the third strip, a moistening agent is distributed along at least one of the two parts 63A and 63B, preferably at least along the part 63B ($f_a$ being the direction of movement). This distribution is carried out usually by normal equipment, so as to deposit the moistening agent in a linear arrangement as indicated by 73. The distribution can be effected as the form is moving in the direction indicated by the arrow $f_a$, after the form has been folded longitudinally as shown in FIG. 7.

Consequently, the forms, which move as a continuous web N through the compilation apparatus, have no pre-glued surfaces on their rear surfaces in any position corresponding with a region in which they cross or slide on the backing plate of dimension DP, but only regions comprising dry glue, which does not foul as it is thermosetting. This thus obviates the drawbacks, complained of at the present time, of having to interrupt operation of the compilation apparatus because of the presence of pre-glued surfaces which tend to foul the plate.

The moistening agent 73, distributed in order to activate the dry glue of the region 63B, can provide a fixing which is stable and thus more secure than that obtained by pre-glued regions. Even so, the closed form can be read by detaching along the lines 61,62 and along the region 64.

Besides the two regions 51 and 53, at least one region 53X or even more regions can be provided adjacent to the region 53 in order to extend the useful surface for compilation beyond the edge 53B. These regions are bounded by creasing lines.

The distribution of dry glue along the strip 63 can either be limited to only one half its length, or can comprise its complete length. The moistening agent can be distributed on one or other or on both havles of the strip, and by adopting any necessary arrangements, such as annular channels on the folding rollers, in order to prevent any undesirable moistening.

What I claim is:

1. A form having a front surface adapted to be printed on and a rear surface;

said form being defined by a first rectangular region having two parallel longitudinal edges and two transverse short edges joining the ends of said longitudinal edges, a second rectangular region having parallel longitudinal edges and short transverse edges joining the ends of said longitudinal edges, and an intermediate region joining adjacent longitudinal edges of said first and second regions, the transverse and longitudinal dimensions of said second region being smaller than those of said first region;

a first creasing line defined along the longitudinal edge of said first region adjacent the intermediate region;

a second creasing line extending across said first and second regions intermediate and parallel to said short transverse edges thereof;

first and second pre-glued sticking strips adapted to adhere together under pressure on the rear surface of the form adjacent said short transverse edges of said first region, said first and second sticking strips leaving an area of the rear surface of said first region having a longitudinal dimension equal to or greater than the longitudinal dimension of said second region free of pre-gluing;

said form being placed in a folded state by first folding said form along said first creasing line to bring the rear surfaces of said first and second regions face to face, and then folding the form along said second creasing line so as to bring said pre-glued sticking strips into contact with one another to hold said form in said folded state.

2. A form according to claim 1, further including a region of dry adhesive provided on the rear surface of said first region adjacent said longitudinal edge thereof opposite said intermediate region.

3. A form according to claim 1, further including a pre-glued sticking strip on the front surface of said intermediate region.

4. A message form having a flat and folded state comprising a blank of flat readily foldable sheet material having a front surface and a rear surface, said front surface being adapted to be imprinted with a predetermined message, a crease line extending longitudinally said blank intermediate with the width thereof to define a pair of rectangular regions, one of said regions being slightly smaller than the other region, a separation line extending parallel to said crease line and spaced therefrom, and said other region having marginal edges extending beyond the corresponding edges of said smaller region, said marginal edges being coated with a pressure sensitive adhesive on the rear surface thereof, and a layer of pressure sensitive adhesive coating the front surface of said blank between said crease line and said separation line, and a transversely extending central line disposed intermediate the opposed edges of said blank whereby said blank can be first folded along said longitudinally extending crease line so that said smaller region is disposed contiguous to the back surface of said larger region, and then folded about said transverse central line whereby the adhesive coated surface of said marginal edges are disposed in contacting relationship.

5. A message form as defined in claim 4, wherein said smaller region and said larger region have their corresponding free edges slightly spaced from one another in the first folded position thereof, and layer of adhesive disposed on the rear surface of said blank adjacent the free longitudinal edge of said larger region.

6. A message form as defined in claim 5 wherein said layer of adhesive extending along the free edge of said larger region is a thermosetting adhesive which requires moisture for adhesion when folded about said central line.

7. A message form as defined in claim 4 where the rear surface of said blank adjacent the free longitudinal edge of said larger region is not pre-glued.

8. A message form as defined in claim 4 wherein the rear surface of said blank adjacent the free longitudinal edge of said larger region is provided with a layer of adhesive before the second folding along said central line.

* * * * *